US008602071B1

(12) United States Patent
Eno

(10) Patent No.: US 8,602,071 B1
(45) Date of Patent: Dec. 10, 2013

(54) BAG FILLING ASSEMBLY

(76) Inventor: Mark S. Eno, Oxford, MI (US)

( * ) Notice: Subject to any disclaimer, the term of this patent is extended or adjusted under 35 U.S.C. 154(b) by 221 days.

(21) Appl. No.: 13/208,792

(22) Filed: Aug. 12, 2011

(51) Int. Cl.
*B65B 1/04* (2006.01)

(52) U.S. Cl.
USPC ..... 141/315; 141/114; 141/337; 141/341; 141/365

(58) Field of Classification Search
USPC ..... 141/114, 313, 314, 315, 331, 337, 340, 141/341, 364, 365
See application file for complete search history.

(56) References Cited

U.S. PATENT DOCUMENTS

| | | | | |
|---|---|---|---|---|
| 798,019 | A * | 8/1905 | Deuel | 141/75 |
| 1,230,060 | A * | 6/1917 | Bergstrom | 248/97 |
| 1,254,371 | A * | 1/1918 | Smith | 248/101 |
| 2,827,931 | A | 3/1958 | Melvin | |
| 3,335,769 | A * | 8/1967 | Ilg | 141/340 |
| 3,722,557 | A * | 3/1973 | Huggins | 141/59 |
| 4,133,356 | A | 1/1979 | Dillingham | |
| 4,248,278 | A | 2/1981 | Blodgett | |
| D391,724 | S | 3/1998 | Blackburn | |
| 5,918,651 | A | 7/1999 | Gazdy | |
| 6,035,908 | A | 3/2000 | Hoffmann | |
| 6,776,197 | B1 * | 8/2004 | DeCrane | 141/10 |
| 6,896,015 | B2 * | 5/2005 | Beveridge | 141/314 |
| 6,932,126 | B1 * | 8/2005 | Spagnolo | 141/316 |
| 7,174,924 | B2 * | 2/2007 | Ours et al. | 141/10 |
| 2007/0169843 | A1 * | 7/2007 | Henderleiter | 141/315 |
| 2009/0293990 | A1 * | 12/2009 | Mackrill et al. | 141/313 |

* cited by examiner

*Primary Examiner* — Jason K Niesz

(57) ABSTRACT

A bag filling assembly is provided for facilitating clean and efficient filling of a flexible resealable storage bag. The assembly includes a frame and a pole coupled to and extending from the frame. The pole has a top and a bottom with the bottom being coupled to the frame. A funnel is coupled to the top of the pole and includes an open bottom, an open top, and a perimeter wall extending between the open bottom and the open top. A bag support is coupled to the frame and positioned under the funnel for supporting a bag under the funnel to receive matter passing through the funnel.

16 Claims, 5 Drawing Sheets

BAG FILLING ASSEMBLY

BACKGROUND OF THE DISCLOSURE

Field of the Disclosure

The disclosure relates to bag filling devices and more particularly pertains to a new bag filling device for facilitating clean and efficient filling of a flexible resealable storage bag.

SUMMARY OF THE DISCLOSURE

An embodiment of the disclosure meets the needs presented above by generally comprising a frame and a pole coupled to and extending from the frame. The pole has a top and a bottom with the bottom being coupled to the frame. A funnel is coupled to the top of the pole and includes an open bottom, an open top, and a perimeter wall extending between the open bottom and the open top. A bag support is coupled to the frame and positioned under the funnel for supporting a bag under the funnel to receive matter passing through the funnel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
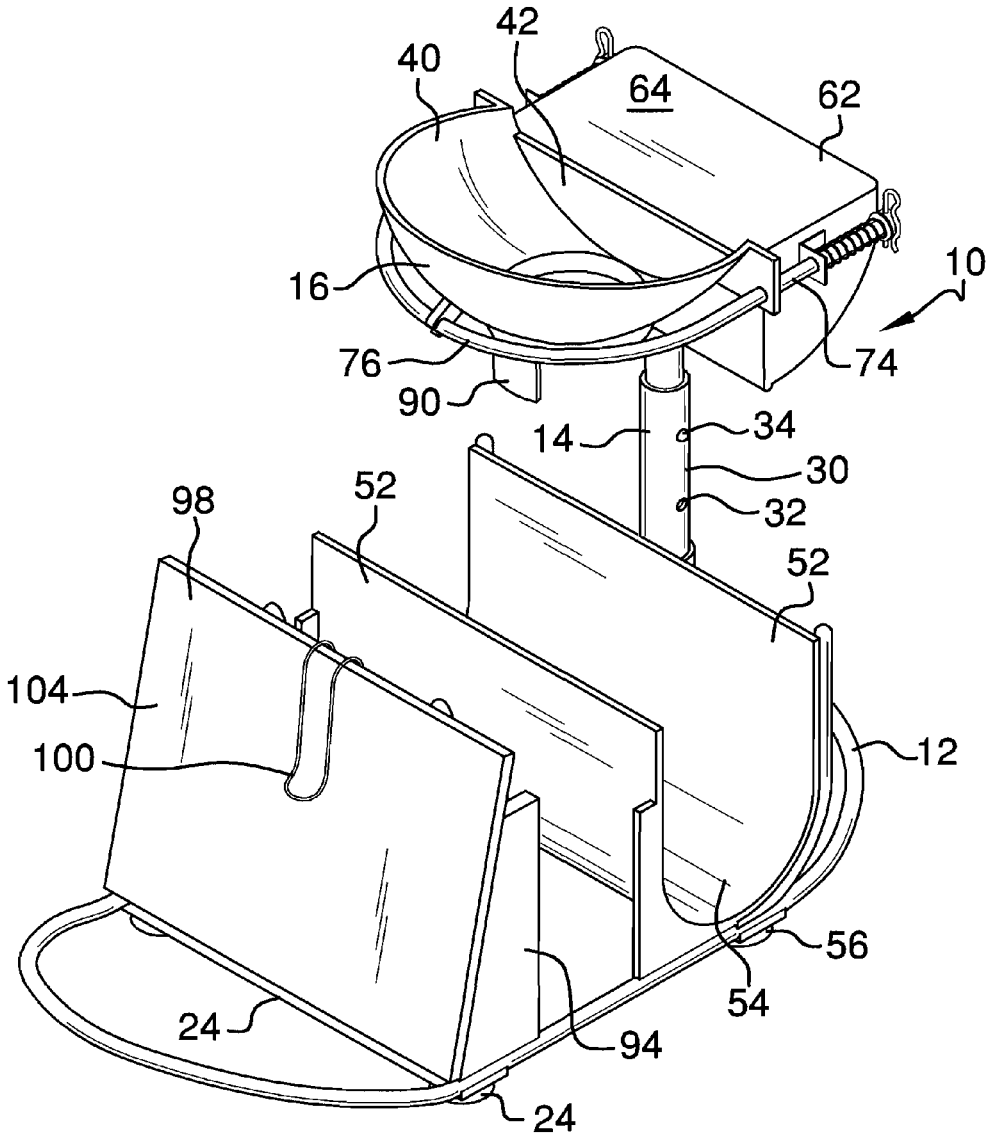
FIG. 1 is a top front side perspective view of a bag filling assembly according to an embodiment of the disclosure.
Figure 3:
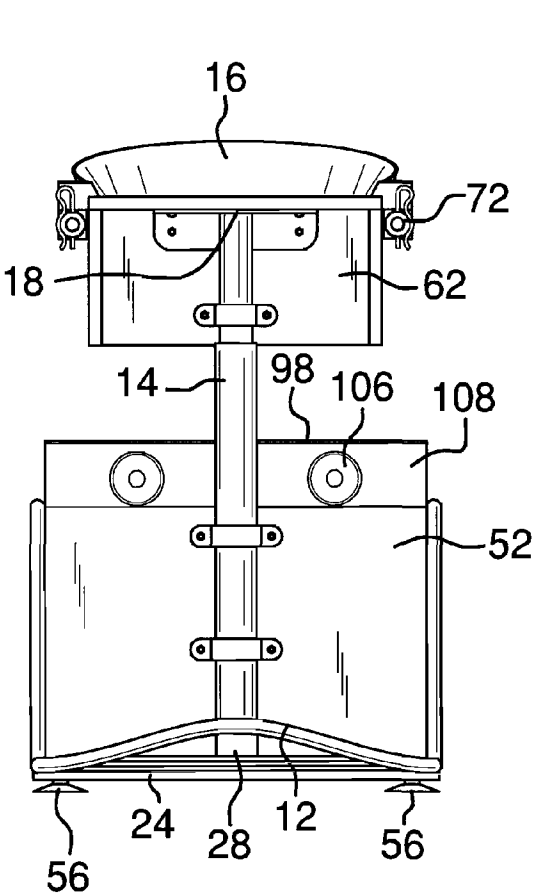
FIG. 3 is a back view of an embodiment of the disclosure.
Figure 2:
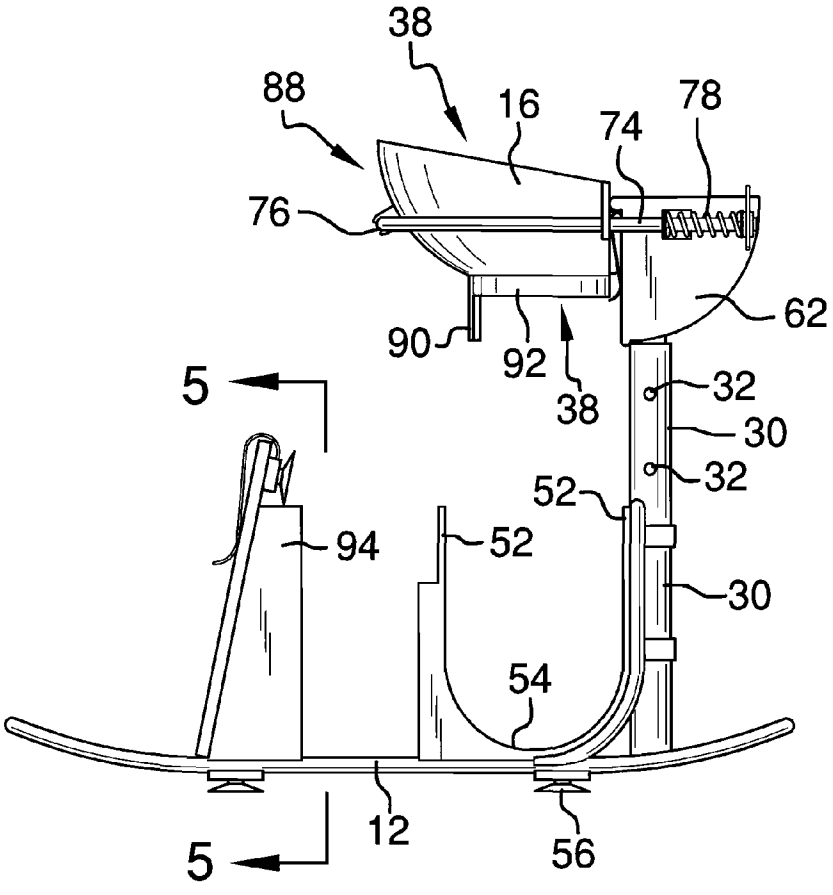
FIG. 2 is a side view of an embodiment of the disclosure.
Figure 5:
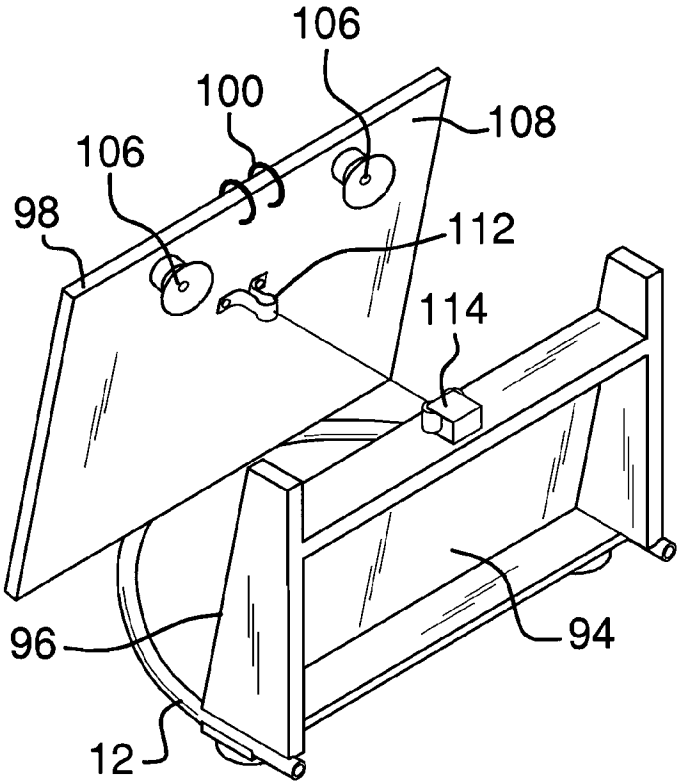
FIG. 5 is a top back side perspective partially exploded view of an embodiment of the disclosure.
Figure 4:
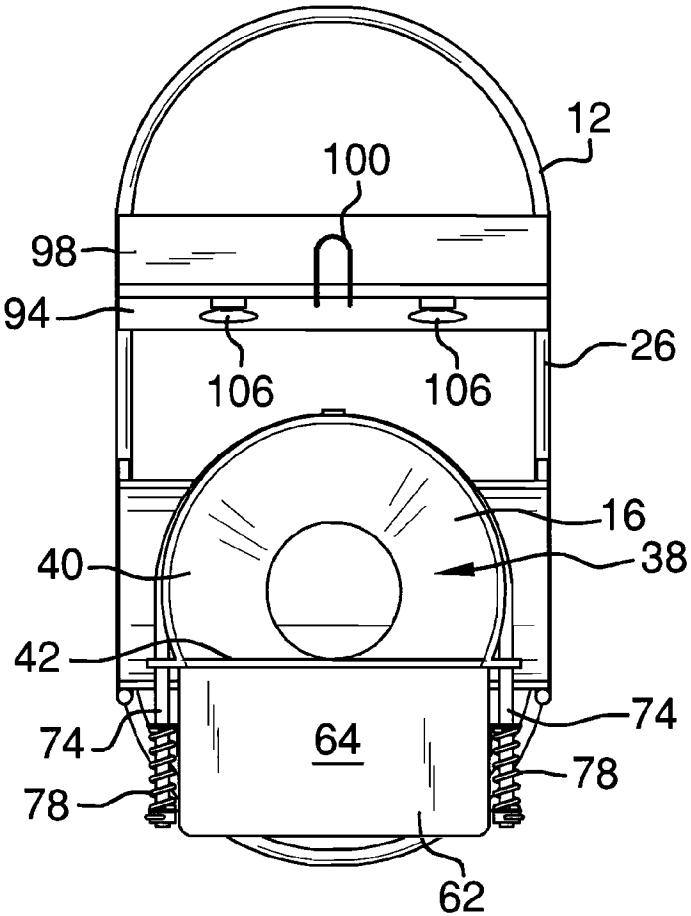
FIG. 4 is a top view of an embodiment of the disclosure.
Figure 6:
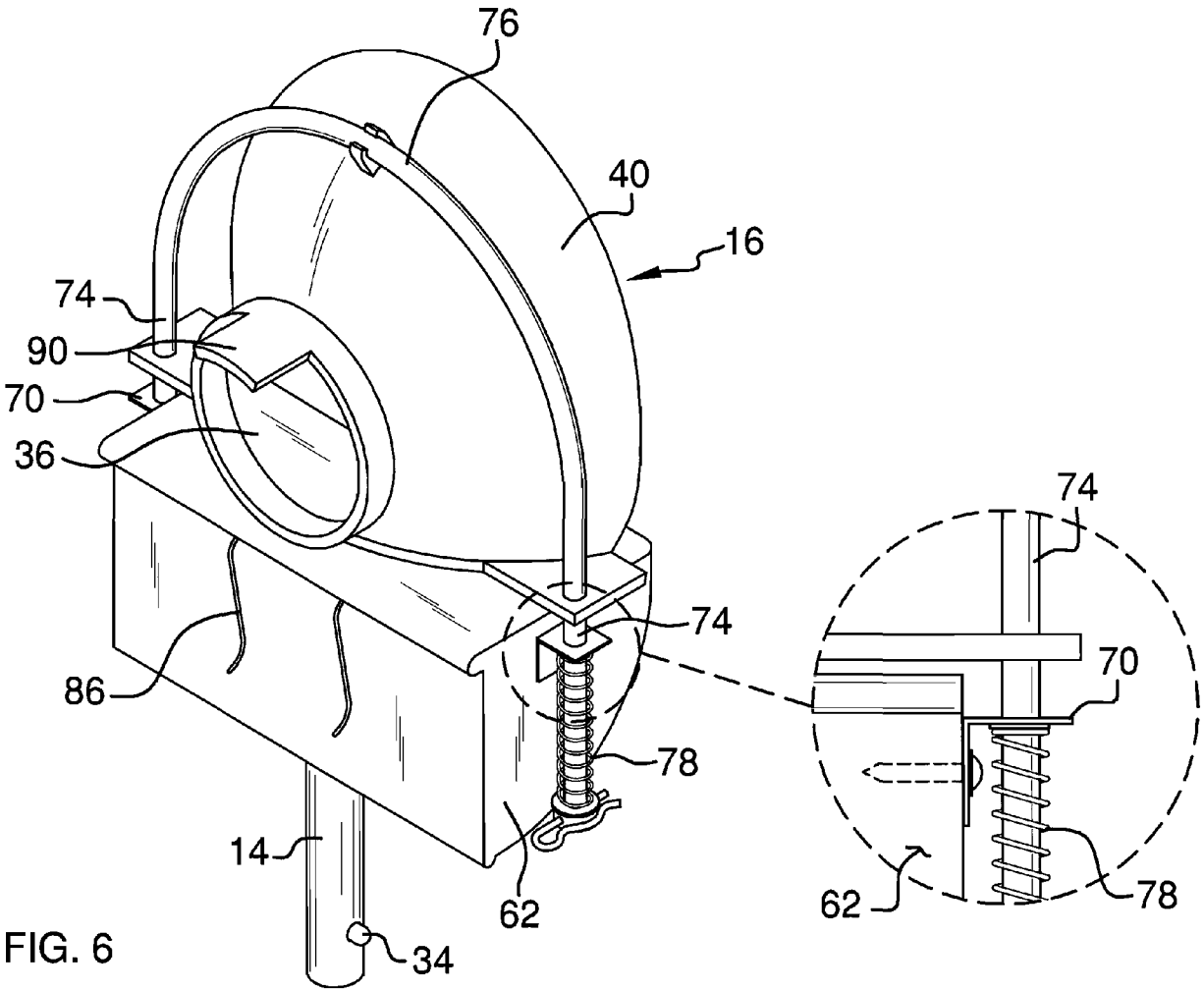
FIG. 6 is a top front side perspective view of an embodiment of the disclosure.
Figure 7:
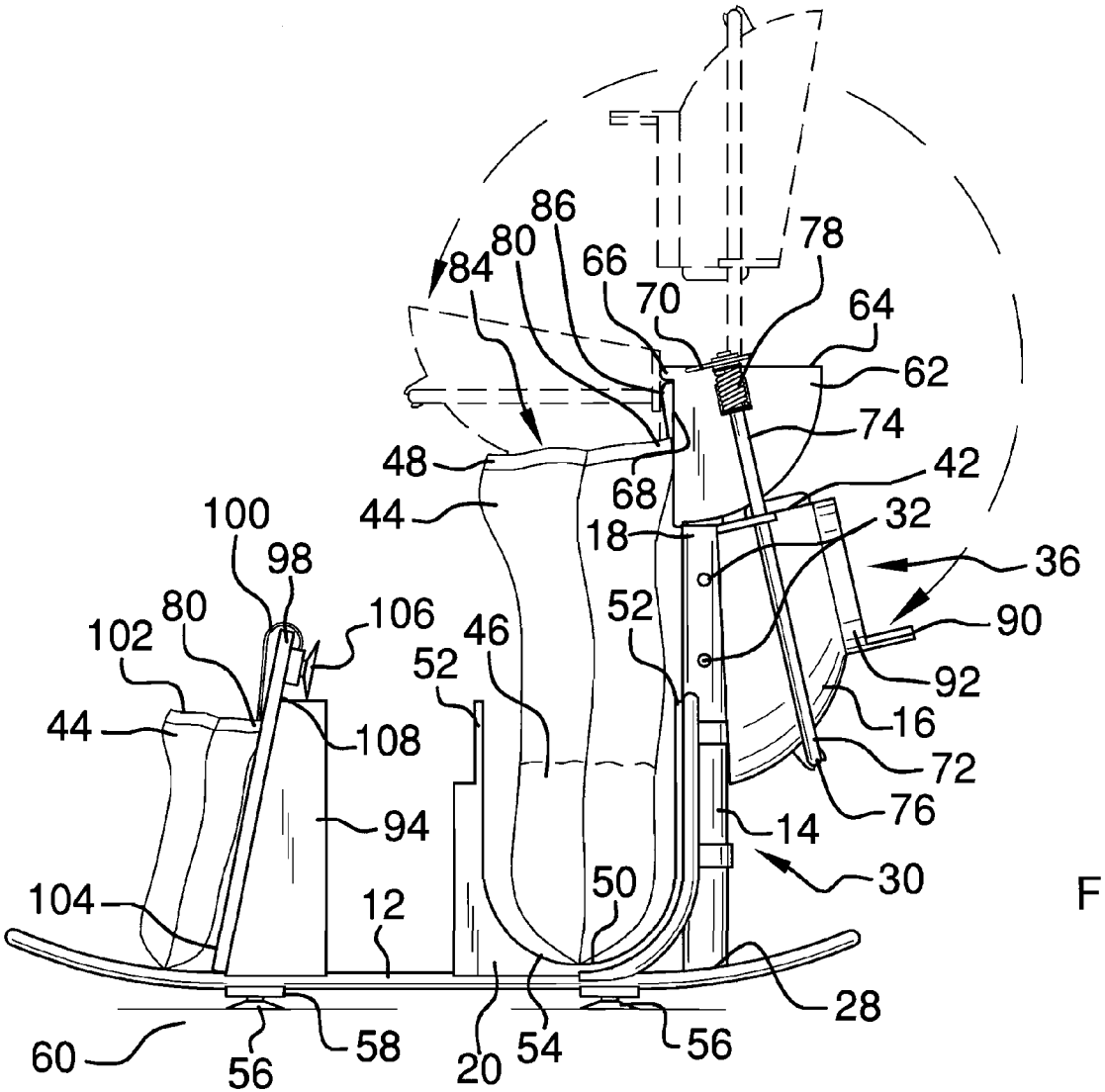
FIG. 7 is a detailed front view of an embodiment of the disclosure.

With reference now to the drawings, and in particular to FIGS. 1 through 7 thereof, a new bag filling device embodying the principles and concepts of an embodiment of the disclosure and generally designated by the reference numeral 10 will be described.

As best illustrated in FIGS. 1 through 7, the bag filling assembly 10 generally comprises a frame 12, a pole 14 coupled to and extending from the frame 12, a funnel 16 coupled to a top 18 of the pole 14, and a bag support 20 coupled to the frame 12.

The frame 12 may comprise a tubular structure having a pair of spaced cross bars 24 and an oblong or oval outer perimeter shape 26. The pole 14 has a bottom 28 that is coupled to the frame 12. The pole 14 is telescopic for selectively adjusting a length of the pole 14. This may be achieved by utilizing nested tubes 30 having alignable holes 32 and a spring-loaded pin 34 depressible to permit adjustment of the length of the pole 14.

The funnel 16 is coupled to the top 18 of the pole 14. The funnel 16 has an open bottom 36, an open top 38, and a perimeter wall 40 extending between the open bottom 36 and the open top 38. The bag support 20 is coupled to the frame 12. The bag support 20 is positioned under the funnel 16 for supporting a bag 44 under the funnel 16 to receive matter 46 passing through the funnel 16. The pole 14 is adjusted for positioning the funnel 16 at a top 48 of variously sized bags 44 when a bottom 50 of the bag 44 is supported by the bag support 20. The bag support 20 may have a pair of spaced parallel walls 52 and a curved floor 54 extending between and joining the spaced walls 52 of the bag support 20. The curved floor 54 assists in centering the matter 46 settling into the bag 44. A plurality of suction cups 56 coupled to a bottom 58 of the frame 12 for coupling the frame 12 in a stable position on a support surface 60.

A table 62 may also be provided having a flat upper surface 64. The table 62 is coupled to the top 18 of the pole 14. The funnel 16 is pivotally coupled to the table 62. The perimeter wall 40 may have a flat portion 42 positionable adjacent to a side 68 of the table 62 for nesting against the table 62 beneath a lip 66. A pair of brackets 70 may be pivotally coupled to the table 62 and an elongated funnel arm 72 provided having two straight end portions 74 and a curved medial portion 76. The curved medial portion 76 extends between the straight end portions 74 and the funnel 16 is coupled to the curved medial portion 76. Each of the straight end portions 74 is slidably inserted through an associated one of the brackets 70. Each of a pair of springs 78 is coupled between one of the straight end portions 74 and an associated one of the brackets 70 whereby the funnel support arm 72 is urged towards the table 62. Thus, the funnel 16 is configured for clipping a side 80 of an open top 84 of the bag 44 between the funnel 16 and the table 62. A separate bag clip 86 may also be provided and positioned on the table 62 between the table 62 and the funnel 16 when the funnel 16 is pivoted down into a use position 88.

The open bottom 36 of the funnel 16 may be defined by an annular wall 92. A projection 90 may extend downwardly from the open bottom 36 as an extension of part of the annular wall 92 for insertion into the open top 84 of the bag 44 to facilitate holding the bag 44 in an open position.

A rack 94 may also be coupled to the frame 12. The rack 94 may have a tilted front face 96 for supporting a panel 98 that is removably coupled to the rack 94. A male connector 112 and a female connector 114 may be provided to hold the panel 98 in a stable upright position against the rack 94 permitting filling of the bag 44 in an upright position against the panel 98. A clip 100 is coupled to the panel 98 and configured for clipping to a top 102 of a bag 44. The clip 100 extends across a first face 104 of the panel 98. A pair of suction cups 106 may be coupled to the panel 98 and positioned on a second face 108 of the panel 98 so that the first face 104 faces upwardly when the suction cups 106 are pressed against the supporting surface 60. Thus, the panel 98 may be oriented horizontally while placing an item such as a sandwich into the bag 44 if so desired.

In use, the assembly 10 provides various options to facilitate filling the bag 44 depending on the type of matter 46 being stored in the bag 44 and the size of the bag 44. The funnel 16 may be pivoted upwardly away from the table 62 and the bag 44 clipped to the table 62 by pivoting the funnel 16 downwardly to abut the table 62. The bag 44 is held open by the projection 90 and the bag support centers and supports the matter 46 entering the bag 44 through the funnel 16. Alternatively, the panel 98 may be utilized either while attached to the rack 94 or detached from the rack 94 in a horizontal position if so desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A bag filling assembly comprising:

a frame;

a pole coupled to and extending from said frame, said pole having a top and a bottom, said bottom being coupled to said frame;

a funnel coupled to said top of said pole, said funnel having an open bottom, an open top, and a perimeter wall extending between said open bottom and said open top;

a bag support coupled to said frame, said bag support being positioned under said funnel whereby said bag support is configured for supporting a bag under said funnel to receive matter passing through said funnel; and a table having a flat upper surface, said table being coupled to said top of said pole, said funnel being pivotally coupled to said table, said perimeter wall of said funnel having a flat portion, said flat portion being positioned adjacent to a side of said table.

2. The assembly of claim 1, further including a plurality of suction cups coupled to a bottom of said frame whereby said frame is configured for coupling to a support surface.

3. The assembly of claim 1, further comprising:

a pair of brackets pivotally coupled to said table;

an elongated funnel arm having two straight end portions and a curved medial portion extending between said straight end portions, said funnel being coupled to said curved medial portion, each of said straight end portions being slidably inserted through an associated one of said brackets; and a pair of springs, each spring being coupled between one of said straight end portions and an associated one of said brackets whereby said funnel support is urged towards said table such that said funnel is configured for clipping a side of an open top of the bag between said funnel and said table.

4. The assembly of claim 3, further including a projection extending downwardly from said open bottom of said funnel, said projection being configured for insertion into the open top of the bag whereby the bag is held in an open position.

5. The assembly of claim 1, further comprising:

a pair of spaced parallel walls of said bag support; and a curved floor of said bag support extending between and joining said spaced walls of said bag support.

6. The assembly of claim 1, further including said pole being telescopic for selectively adjusting a length of said pole whereby said pole is configured for positioning said funnel at a top of variously sized bags when a bottom of the bag is supported by said bag support.

7. A bag filling assembly comprising:

a frame;

a pole coupled to and extending from said frame, said pole having a top and a bottom, said bottom being coupled to said frame;

a funnel coupled to said top of said pole, said funnel having an open bottom, an open top, and a perimeter wall extending between said open bottom and said open top;

a bag support coupled to said frame, said bag support being positioned under said funnel whereby said bag support is configured for supporting a bag under said funnel to receive matter passing through said funnel;

a rack coupled to said frame;

a panel removably coupled to said rack; and a clip coupled to said panel, said clip being configured for clipping to a top of a bag.

8. The assembly of claim 7, further comprising:

said clip extending across a first face of said panel; and a pair of suction cups coupled to said panel, said suction cups being positioned on a second face of said panel.

9. A bag filling assembly comprising:

a frame;

a pole coupled to and extending from said frame, said pole having a top and a bottom, said bottom being coupled to said frame, said pole being telescopic for selectively adjusting a length of said pole;

a funnel coupled to said top of said pole, said funnel having an open bottom, an open top, and a perimeter wall extending between said open bottom and said open top, said perimeter wall of said funnel having a flat portion;

a bag support coupled to said frame, said bag support being positioned under said funnel whereby said bag support is configured for supporting a bag under said funnel to receive matter passing through said funnel and said pole is configured for positioning said funnel at a top of variously sized bags when a bottom of the bag is supported by said bag support, said bag support having a pair of spaced parallel walls and a curved floor extending between and joining said spaced walls of said bag support;

a plurality of suction cups coupled to a bottom of said frame whereby said frame is configured for coupling to a support surface;

a table having a flat upper surface, said table being coupled to said top of said pole, said funnel being pivotally coupled to said table, said flat portion of said perimeter wall being positioned adjacent to a side of said table;

a pair of brackets pivotally coupled to said table;

an elongated funnel arm having two straight end portions and a curved medial portion extending between said straight end portions, said funnel being coupled to said curved medial portion, each of said straight end portions being slidably inserted through an associated one of said brackets;

a pair of springs, each spring being coupled between one of said straight end portions and an associated one of said brackets whereby said funnel support is urged towards said table such that said funnel is configured for clipping a side of an open top of the bag between said funnel and said table;

a projection extending downwardly from said open bottom of said funnel, said projection being configured for insertion into the open top of the bag whereby the bag is held in an open position;

a rack coupled to said frame;

a panel removably coupled to said rack;

a clip coupled to said panel, said clip being configured for clipping to a top of a bag, said clip extending across a first face of said panel; and a pair of suction cups coupled to said panel, said suction cups being positioned on a second face of said panel.

10. The assembly of claim 7, further including a plurality of suction cups coupled to a bottom of said frame whereby said frame is configured for coupling to a support surface.

11. The assembly of claim 7, further comprising:

a table having a flat upper surface, said table being coupled to said top of said pole; and said funnel being pivotally coupled to said table.

12. The assembly of claim 11, further including said perimeter wall of said funnel having a flat portion, said flat portion being positioned adjacent to a side of said table.

13. The assembly of claim 12, further comprising:

a pair of brackets pivotally coupled to said table;

an elongated funnel arm having two straight end portions and a curved medial portion extending between said straight end portions, said funnel being coupled to said curved medial portion, each of said straight end portions being slidably inserted through an associated one of said brackets; and a pair of springs, each spring being coupled between one of said straight end portions and an associated one of said brackets whereby said funnel support is urged towards said table such that said funnel is configured for clipping a side of an open top of the bag between said funnel and said table.

14. The assembly of claim 13, further including a projection extending downwardly from said open bottom of said funnel, said projection being configured for insertion into the open top of the bag whereby the bag is held in an open position.

15. The assembly of claim 7, further comprising:

a pair of spaced parallel walls of said bag support; and a curved floor of said bag support extending between and joining said spaced walls of said bag support.

16. The assembly of claim 7, further including said pole being telescopic for selectively adjusting a length of said pole whereby said pole is configured for positioning said funnel at a top of variously sized bags when a bottom of the bag is supported by said bag support.

* * * * *